United States Patent [19]

Knight et al.

[11] 4,272,339

[45] Jun. 9, 1981

[54] PROCESS FOR ELECTROWINNING OF METALS

[76] Inventors: Bill J. Knight, 1000 Silvertree, Tucson, Ariz. 85716; David L. Knight, 4950 N. Camino de Oesta, Tucson, Ariz. 85705

[21] Appl. No.: 164,288

[22] Filed: Jun. 30, 1980

Related U.S. Application Data

[63] Continuation-in-part of Ser. No. 128,444, Mar. 10, 1980, abandoned.

[51] Int. Cl.[3] ..... C25C 1/08; C25C 1/12; C25C 1/16

[52] U.S. Cl. ..... 204/106; 204/107; 204/108; 204/112; 204/113; 204/114; 204/118; 204/293

[58] Field of Search ..... 204/293, 106–108, 204/112–114, 118

[56] References Cited

U.S. PATENT DOCUMENTS

| | | | |
|---|---|---|---|
| 1,158,672 | 11/1915 | Frary et al. | 75/167 |
| 1,158,673 | 11/1915 | Frary et al. | 75/167 |
| 2,013,487 | 9/1935 | Canfield et al. | 75/1 |
| 2,040,078 | 5/1936 | Canfield et al. | 75/167 |
| 2,305,133 | 12/1942 | Campbell | 204/293 |
| 3,755,094 | 8/1973 | Seyb et al. | 204/51 |
| 3,755,112 | 8/1973 | Fountain et al. | 204/108 |
| 3,859,185 | 1/1975 | Hood et al. | 204/108 |
| 3,981,353 | 9/1976 | Knight | 164/332 |
| 4,050,961 | 9/1977 | Knight | 148/32 |
| 4,137,378 | 1/1979 | Nees et al. | 429/245 |
| 4,170,470 | 10/1979 | Marshall et al. | 75/166 D |

OTHER PUBLICATIONS

Bagshaw, N. E., "Pb-Sr Alloys for Battery Grids", *J. Power Sources,* 2(1977/78), pp. 337–350.

Young, J. A. et al., "Cast Pb-Ca-Sn Grids for Maintenance-Free Batteries", presented at 1973 Meeting Battery Council Int'l.

*Primary Examiner*—R. L. Andrews

*Attorney, Agent, or Firm*—Fitch, Even, Tabin, Flannery & Welsh

[57] ABSTRACT

An electrowinning process for the recovery of various metals including copper, zinc and nickel from an aqueous electrolyte in an electrolytic cell containing anodes and cathodes is disclosed wherein the anodes are formed from a lead alloy containing from about 0.05% to about 0.25% by weight strontium. The lead alloy for the anodes also preferably includes from about 0.005% to about 0.1% by weight aluminum alone or in further combination with either about 0.1% to about 5.0% by weight tin or at least 0.01% by weight silver, the lead alloy anodes having a hard, adherent oxide surface layer preferably formed in situ within the electrolytic cell.

9 Claims, No Drawings

PROCESS FOR ELECTROWINNING OF METALS

This is a continuation-in-part of U.S. patent application, entitled PROCESS FOR ELECTROWINNING OF COPPER, Ser. No. 128,444, filed Mar. 10, 1980, now abandoned.

BACKGROUND OF THE INVENTION

The present invention relates to an electrowinning process for the recovery of one of a plurality of metals from an aqueous electrolyte and more specifically to such a process carried out within an electrolytic cell containing spaced apart anodes and cathodes with the anodes being formed from lead or a lead alloy.

Electrowinning processes are widely employed for recovering one of a number of metals from an aqueous electrolyte solution containing ions of the particular metal. Metals suitable for refining by electrowinning processes include, but are not limited to copper, zinc, nickel, antimony, cadmium, chromium, cobalt, manganese and silver. The electrolyte solution is typically placed within an electrolytic cell containing spaced apart anodes and cathodes which are commonly arranged in alternating order. The electrolyte may be a solution of sulfates, sulfides, caustic or nitrates depending upon the particular metal to be refined by electrowinning. During operation, an electrical potential is formed between the anodes and cathodes in order to cause the metal ions from the aqueous electrolyte to deposit upon the cathodes by conventional electrolysis.

In electrowinning processes of the type summarized above, the aqueous electrolyte solution, containing sulfuric acid, in the electrowinning of copper, for example, tends to corrode the surface of the anodes. When the electrowinning process is continued over long periods of time, corrosion not only results in the introduction of lead from the anodes as an impurity in the metal deposited upon the cathode but also results in destruction of the anodes themselves. This in turn disrupts the electrowinning process and requires costly replacement of the relatively massive anodes.

In the prior art, various alloys have been employed for forming such anodes in an attempt to resist corrosion of the type referred to above. One of the earlier replacements for pure metallic lead in the anodes was an alloy formed from lead in combination with antimony. Later, the use of lead-calcium alloys as inert anodes in electrowinning processes for the recovery of copper was disclosed for example by U.S. Pat. No. 3,859,185 issued Jan. 7, 1975.

However, even with the use of such alloys, corrosion has continued to be a problem in electrowinning processes for the recovery of metals such as copper. Accordingly, in view of increasing requirements for various metals subject to refining by means of electrowinning, there has been found to remain a need for an improved electrowinning process employing an insoluble anode and more particularly for such an improved electrowinning process carried out in an electrowinning cell containing spaced apart anodes and cathodes.

SUMMARY OF THE INVENTION

It is therefore an object of the invention to provide an improved electrowinning process for the recovery of a metal selected from a group including but not limited to copper, zinc, nickel, antimony, cadmium, cobalt, manganese, chromium and silver from an aqueous electrolyte containing ions of the selected metal, the process being performed in an electrolytic cell containing the electrolyte with alternating anodes and cathodes disposed therein, an electrical potential being developed between said anodes and cathodes for causing electrolysis within said cell to result in deposition of the metal on said cathodes. The improvement of the present invention comprises the use within the electrolytic cell of anodes which are formed from a lead alloy containing from about 0.5% to about 0.25% by weight strontium.

It is more particularly an object of the invention to provide an electrowinning process of the above type for recovering copper from an aqueous electrolyte, preferably a sulfate solution, containing copper ions.

It is another more particular object of the invention to provide an electrowinning process of the above type for recovering zinc from an aqueous electrolyte, preferably a sulfate or caustic solution, containing zinc ions.

It is yet another more particular object of the invention to provide an electrowinning process of the above type for recovering nickel from an aqueous electrolyte, preferably a sulfate-chloride or all chloride solution, containing nickel ions.

The lead-strontium alloy anodes also preferably include from about 0.005% to about 0.1% by weight aluminum as a sacrificial agent to minimize or eliminate the effects of dross formation during cooling or solidification of the alloy. The lead-strontium alloy anodes even more preferably include either from about 0.1 to about 5.0% by weight tin or at least about 0.01% by weight silver in order to further improve finished characteristics of the lead alloy anodes.

Additional objects and advantages of the present invention are made apparent in the following description of preferred embodiments or examples of the invention.

PREFERRED EXAMPLES OF THE INVENTION

The present invention contemplates an electrowinning process for the recovery of a selected metal from an aqueous electrolyte containing ions of the selected metal, the process preferably being carried out in an electrolytic cell containing the electrolyte forming a conductive path between the spaced apart anodes and cathodes. An electrical potential is then formed between the anodes and cathodes for causing electrolysis within the cell to result in the deposition of the metal on the cathodes.

Generally, the present invention is applicable to all conventional electrowinning processes for the recovery of various metals as summarized above. In the electrowinning of copper, for example, the electrolyte commonly contains from about ten to about three hundred grams of $H_2SO_4$ per liter of solution. The electrolyte also normally contains from about 0.5 to about sixty grams of dissolved copper in the form of copper ions per liter of electrolyte solution. With the electrolyte being disposed in an electrolytic cell containing the spaced apart anodes and cathodes as discussed above, an electrical potential is formed between the anodes and cathodes in order to produce a current density which may vary over a wide range. For example, the electrolytic current density may vary from about five to about forty amperes per square foot, accompanied by a voltage drop per electrode pair of about two volts. However, the present invention may also be applicable to electrolyte concentrations, copper concentrations and current densities either substantially higher or lower than the ranges set forth above. The electrolyte may also consist of other acids besides sulfuric acids and other tankhouse designs may be employed having different arrangements of anodes and cathodes than the common alternating pattern thereof.

The improved electrowinning process of the present invention may be used in the recovery of copper from dilute, acid leach solutions conventionally used for example in leaching copper from copper-bearing materials such as low grade ores and the like. However, it is also to be kept in mind that electrowinning processes of the type contemplated by the present invention may be carried out with more concentrated acid solutions, typically produced in a multi-stage process. However, regardless of the specific details of the electrowinning process, the parameters set forth above as to the concentration of sulfuric acid and copper ions within the electrolyte and as to the characteristics of the electrical potential formed between the anodes and the cathodes as well as the electrolytic current density are believed to be typical.

In the electrowinning of nickel, a similar electrolytic cell arrangement is employed. However, the electrolyte commonly includes a similar concentration of nickel ions in a chloride solution. For example, the electrolytic solution may be formed by dissolving high purity nickel chloride crystals, $NiCl_2.4H_2O$, along with hydrochloric acid, in electrolyte recycled from the electrowinning tank or tanks. The electrolyte is then returned as a feed solution to the electrowinning tank with a nickel content maintained for example at approximately 130 grams per liter. An electrical potential is similarly developed between the anodes and cathodes as described above in the case of electrowinning of copper. Preferably, current density may be maintained in the range of approximately twenty to twenty five amperes per square foot. As in the electrowinning of copper, however, the present invention is also applicable to electrolyte concentrations, nickel concentrations and current densities either substantially higher or lower than the ranges set forth above. The electrolyte may also be of different composition, for example, a mixed chloridesulfate solution. Other tankhouse designs may also be employed having various arrangements of anodes and cathodes.

In the electrowinning of zinc, a similar electrolytic cell arrangement is also employed. The electrolyte commonly includes a similar concentration of zinc ions in a sulfate solution. Preferably, the concentration in the electrolytic cells is maintained at approximately 50 grams per liter of zinc and approximately 150 grams per liter of sulfuric acid. Current density is preferably maintained within the general range of fifty to eighty amperes per square foot. Also as in the electrowinning of copper and nickel, the present invention is also applicable to electrolyte concentrations zinc concentrations and current densities either substantially higher or lower than the ranges set forth above. The electrolyte may also be of different composition, for example, a caustic solution and other tankhouse designs may be employed having various arrangements of anodes and cathodes.

Similar parameters are employed in electrowinning of other metals such as antimony, cadmium, chromium, cobalt, manganese, iron and silver from an aqueous electrolyte containing ions of the particular metal.

Within an electrowinning process for the recovery of a metal such as those set forth above, the present invention particularly contemplates the step of using within the electrolytic cell anodes formed from a lead alloy including from about 0.05 to about 0.25% by weight strontium. More specifically, a preferred range for strontium is from about 0.10 to about 0.22% by weight.

In connection with any electrowinning process such as those described above and as will be made more apparent below, the use of an anode formed from a lead alloy including strontium results in significantly reduced or minimized corrosion over long periods of operation. The effect of strontium within such a binary alloy is particularly noticeable when the weight percentage of strontium is above about 0.05% and even more so above 0.10%.

The upper end of the strontium range is preferably established at about 0.25% by weight because of the tendency for the lead-strontium binary alloy to form a precipitate of lead strontium ($Pb_3Sr$). The lead strontium precipitate further aggregates to form relatively substantial deposits of the precipitate which tend to interfere with the desirable surface characteristics for such alloys. The precipitation of lead-strontium is partially dependent upon the mass of the object being formed from the alloy. Because of the very substantial mass of the inert anodes contemplated by the present invention, formation of such precipitates and aggregates tends to establish the upper limit for strontium at about 0.25% by weight. More preferably, an upper limit for strontium is about 0.22% by weight which is the point at which such precipitation may initially commence. Even more preferably, it is contemplated that such a lead-strontium binary alloy should have approximately 0.15% to approximately 0.2% by weight strontium in order to produce maximum corrosion resistance in the surface of the anode.

In lead-strontium binary alloys of the type contemplated by the present invention, a further effect is noted in that while the alloy is in a molten condition, drossing tends to occur upon its exposed surfaces leading to undesirable surface characteristics for the molten alloy and for masses formed therefrom. Accordingly, it is preferably contemplated to employ aluminum along with the lead-strontium alloy in order to minimize or eliminate dross formation. Accordingly, at least 0.05% aluminum is necessary in order to achieve dross protection. Further, it is contemplated to employ aluminum within the approximate range of 0.005 to approximately 0.1% by weight. Preferably, it is contemplated to employ from about 0.01% to about 0.1% and even more preferably about 0.01% to about 0.02% by weight aluminum for this purpose.

In addition, the invention also contemplates the possible use of other alloying materials along with strontium. Specifically, the present invention also contemplates an electrowinning process using anodes formed from tertiary alloys including lead, strontium and either tin or silver. Initially with regard to tin, its beneficial effect for increasing strength and resisting warping within the anodes is noticeable at a minimum concentration of about 0.1% by weight. A maximum of about 5% by weight of tin may be employed within such an alloy. However, for purposes of economy and effective performance, an upper limit for tin is contemplated at about 2% by weight.

Similarly, a tertiary alloy including lead, strontium and silver is desirable because of the ability of silver to promote the formation of a dense, hard, adherent layer of lead dioxide upon the finished anode. This characteristic appears to be generally proportional to the amount of silver employed within the alloy. However, generally a minimum of at least 0.01% by weight of silver is necessary to achieve this purpose.

In either of the tertiary alloys described above, strontium continues to perform its basic function of minimizing or reducing corrosion on the surface of the anode and the same specific percentage limitations as discussed above also apply within such tertiary alloys. At the same time, it is also contemplated to employ aluminum as a sacrificial dross preventing agent within either the binary alloy of lead-strontium or the tertiary alloys of either lead-strontium-tin or lead-strontium-silver.

Regardless of the specific alloy employed for the anodes, the anodes may be formed by a number of different techniques. For example, one casting technique for forming individual anodes is disclosed and claimed in U.S. Pat. No. 3,981,353 issued Sept. 21, 1976 as well as in U.S. Pat. No. 4,050,961 issued to the inventor of the present invention. Those patents relate to a process for individually casting anodes within an enclosed mold cavity for even further enhancing finished surface characteristics of the anode. Accordingly, the entire disclosure of those patents is incorporated herein by reference. However, it is to be kept in mind that the present invention is not limited to the use of anodes formed by that specific technique. For example, the electrowinning processes of the present invention may also employ anodes which are formed for example by cold rolling from billets of the alloy material. In addition, the anodes may also be formed by continuous casting or by other techniques as well.

Regardless of the specific method of forming the anodes, the alloy from which the anodes are to be made is initially formed by blending together the lead, strontium and other alloying agents as well as aluminum in accordance with the preceding description. For example, the metals may be admixed and reduced to particulate form in a selected ratio, the particulate blend then being melted in a furnace or the like before casting.

Otherwise, conventional smelting procedures may be used in preparing the alloys. Specifically and preferably, it is generally desirable to add aluminum during initial formation of the alloy especially if the alloying operation is performed with exposure to the atmosphere. In order to form small quantities such as are contemplated by the following examples, the alloys may also be formed from master alloys containing the various desired materials. For example, strontium and aluminum may be present in a single master alloy or in separate master alloys employed for preparation of a final alloy containing those metals. Similar techniques may also be used when either tin or silver is to be employed within the alloy.

In any event, the desirable properties and characteristics for the anode alloys employed within the electrowinning processes of the present invention are more clearly demonstrated by the following examples:

EXAMPLE I

A first example consists of an alloy formed from about 0.18% by weight strontium, about 0.10% by weight tin and about 0.015% by weight aluminum, the balance essentially lead.

The alloy was prepared from a single master alloy containing approximately 2% strontium, 10% tin and 0.2% aluminum. Approximately 10% by weight of the master alloy was combined with approximately 90% by weight of lead. The alloy was formed into the anode in a casting technique of the type disclosed by the above-noted references. Approximately eighteen anodes were then arranged in an electrolytic cell in alternating relation with a number of cathodes, the cell being filled with a suitable electrolyte, electrolysis being carried out according to the preceding description over a period of approximately two years.

Upon initial installation of the anodes within the electrolytic solution, initial inductance occurred over a period of approximately two to three days to result in the formation of a film of lead oxide ($PbO_2$) on the surfaces of the anodes.

After the induction period, the corrosion rate or rate of weight loss for the anodes was monitored over the two-year period and was found to result in a corrosion rate of approximately one to two pounds per year per anode having dimensions of about 32 by 40 inches and an exposed surface area of about 2,560 square inches, that value being an average for the eighteen anodes in the common electrolytic cell.

A number of additional examples as set forth below demonstrate the utility of a binary alloy containing lead and strontium preferably together with aluminum as a sacrificial dross preventing agent.

EXAMPLE II

The invention similarly contemplates the manufacture and use of a similar set of anodes as described in connection with Example I but containing from approximately 0.05 to about 0.10% by weight strontium and about 0.01% aluminum, the balance essentially lead. It is preferably contemplated that Example II include about 0.07 to about 0.08% strontium.

EXAMPLE III

Yet another example is contemplated by the present invention under the same conditions described above in connection with Example I but with the anodes being formed from an alloy including approximately 0.15% by weight strontium and approximately 0.01% by weight aluminum, the balance essentially lead.

EXAMPLE IV

This example is again contemplated to employ the same process described above in connection with Example I with an anode formed from an alloy containing approximately 0.22% by weight strontium and approximately 0.01% by weight aluminum, the balance essentially lead.

In each of Examples II–IV as in Example I, the presence of strontium enhances corrosion resistance and is contamplated to have similar test results as specifically described for Example I.

EXAMPLE V

A final example again contemplates the same process described above in connection with Example I but with anodes formed from an alloy containing approximately 0.12% by weight strontium, approximately 0.05% by weight silver and approximately 0.01% by weight aluminum, balance essentially lead.

The Example V alloy, taken together with the Example I alloy, indicates the ability of strontium to achieve corrosion resistance even in the presence of additional alloying agents. Within the Example V composition, the silver additionally enhances the formation of a lead dioxide film upon the anodes to even further minimize or limit weight loss from corrosion effects. In this regard, it is also noted that the anodes produced according to Example I exhibited increased strength and resistance to warping because of the presence of tin.

Accordingly, there has been disclosed a number of examples indicating the desirability of an electrowinning process for the recovery of lead employing anodes formed from lead alloys including strontium either alone or together with other alloying agents and preferably also including aluminum as a sacrificial dross preventing agent. Modifications and variations in addition to those disclosed above will also be apparent so that the scope of the present invention is defined only by the following appended claims.

What is claimed is:

1. In an electrowinning process for recovering a selected metal from an aqueous electrolyte containing ions of the selected metal, the process being performed in an electrolytic cell containing the electrolyte with spaced apart anodes and cathodes disposed therein, an electrical potential being produced between said anodes and cathodes for causing electrolysis within said cell to result in the deposition of the selected metal on said cathodes, the improvement comprising the step of using within the electrolytic cell anodes which are formed from a lead alloy containing from about 0.05 to about 0.25% by weight strontium.

2. The process of claim 1 wherein said alloys also include from about 0.005% to about 0.1% by weight aluminum.

3. The process of claim 2 wherein the anodes are formed from an alloy also including from about 0.1% to about 5.0% by weight tin.

4. The process of claim 3 wherein the anodes are formed from a lead alloy containing about 0.05% to about 0.25% by weight strontium, about 0.005% to about 0.1% by weight aluminum, about 0.8% to about 2.0% by weight tin, balance essentially lead.

5. The process of claim 2 wherein the anode consists of from about 0.10% to about 0.22% by weight strontium and from about 0.01% to about 0.1% by weight aluminum, the remainder being lead.

6. The process of claim 5 wherein the anodes are formed from a lead alloy also including at least approximately 0.01% by weight silver.

7. The process of claim 5 further comprising the step of initially forming a hard, adherent oxide surface layer upon said anodes.

8. The process of claim 7 wherein the hard, adherent oxide surface layer is formed in situ within said electrolytic cell.

9. The process of claim 1 wherein the metal is selected from the group consisting of copper, zinc and nickel.

* * * * *

UNITED STATES PATENT AND TRADEMARK OFFICE

CERTIFICATE OF CORRECTION

PATENT NO. : 4,272,339

DATED : June 9, 1981

INVENTOR(S) : Bill J. Knight, David L. Knight

It is certified that error appears in the above-identified patent and that said Letters Patent are hereby corrected as shown below:

Col. 2, l. 10 "0.5%" should be --0.05%--.

Col. 3, l. 25, "electrolytic" should be -- electrolyte --.

Signed and Sealed this

*Twenty-second* Day of *September 1981*

[SEAL]

*Attest:*

GERALD J. MOSSINGHOFF

*Attesting Officer*

*Commissioner of Patents and Trademarks*